United States Patent [19]

Hubbard

[11] Patent Number: 4,586,197

[45] Date of Patent: May 6, 1986

[54] AERODYNAMICALLY STABILIZED MOTORCYCLIST HELMET

[76] Inventor: Stirling J. Hubbard, 206 Roosevelt St., Lafayette, La. 70501

[21] Appl. No.: 696,993

[22] Filed: Jan. 31, 1985

[51] Int. Cl.[4] ..... A42B 3/02
[52] U.S. Cl. ..... 2/410; 2/425
[58] Field of Search ..... 2/410, 422, 424, 425

[56] References Cited

U.S. PATENT DOCUMENTS

D. 203,153 12/1965 Marchello ..... 2/410 X

FOREIGN PATENT DOCUMENTS 3305735 8/1984 Fed. Rep. of Germany ..... 2/410
3306820 9/1984 Fed. Rep. of Germany ..... 2/422
2384422 11/1978 France ..... 2/422

*Primary Examiner*—Louis K. Rimrodt
*Attorney, Agent, or Firm*—James B. Lake, Jr.

[57] ABSTRACT

An inverted visor fixed to lower back rim of a motorcycle helmet to extend upwardly and backwardly therefrom and around a lower back portion thereof and adjustable for varying speeds of travel by a forward and backward tilt of wearer's head to maximum neck muscles relaxation for each speed.

2 Claims, 5 Drawing Figures

AERODYNAMICALLY STABILIZED MOTORCYCLIST HELMET

BACKGROUND OF THE INVENTION

1. Field of the Invention

The invention relates generally to safety helmets for motorcycle riders, and more particularly to an aerodynamically stabilized motorcyclist helment adjustable by wearer to varying motorcycle speeds.

2. Description of the Prior Art

A search of the prior art disclosed only an ornamental design for a fireman's helmet, see Neff U.S. Pat. No. Des. 263,431 having a short forwarding descending front visor and a longer rearwarding descending back visor.

SUMMARY OF THE INVENTION

It is an object of the invention to provide an aerodynamically stabilized safety helmet for motor cyclists in which a flat plate wind pressure, resulting from and in direct proportional to the speed of the cycle and against the front part of the helmet is substantially counteracted by an induced wind pressure against the back part.

Another object to the invention is to provide an easy means for varying the counteracting wind pressure against the back of an aerodynamically stabilized helmet in accordance with the speed of the motorcycle and resulting wind pressure against the front part of the helmet.

Yet another object of the invention is to provide means for riding on a motorcycle at varying speeds and extended periods comfortably with relaxed neck muscles.

DETAILED DESCRIPTION OF THE PREFERRED EMBODIMENTS

Figure 1:
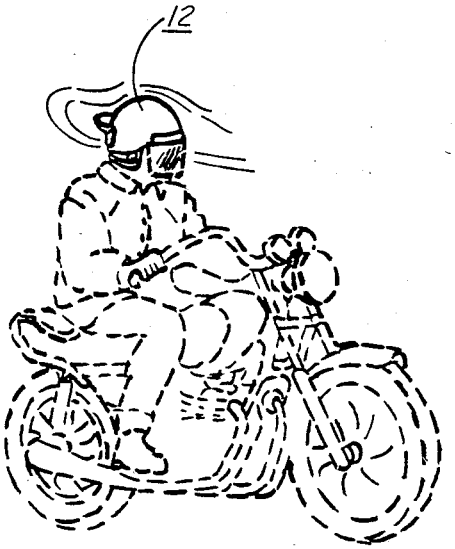
FIG. 1 is a three dimensional view from a side and ahead of a rider and motorcycle showing invention operably positioned.
Figure 2:
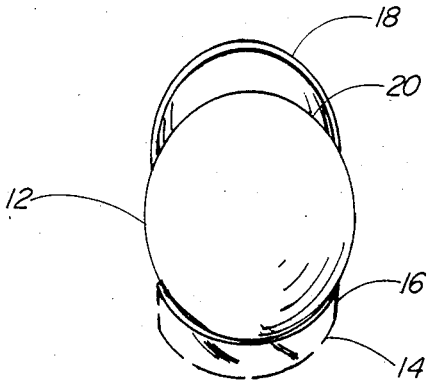
FIG. 2 is a top view of the invention.
Figure 4:
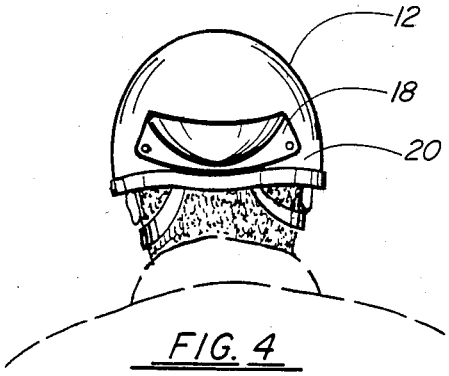
FIG. 4 is a rear view of the invention operably positioned.
Figure 3:
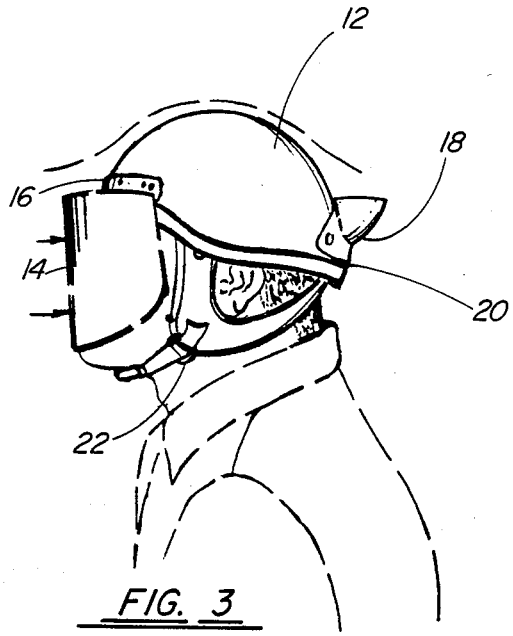
FIG. 3 is a side elevation of the invention as positioned at low speeds.
Figure 3A:
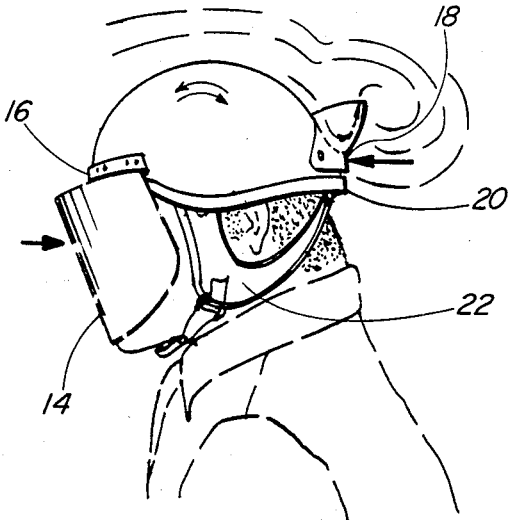
FIG. 3*a* is similar to FIG. 3 but positioned for stabilization at increased motorcycle speed.

Referring to FIGS. 1 and 2, the invention comprises a safety helmet 12 with a depending face shield 14 fixed to the lower front rim 16 of said helmet, and an inverted backvisor 18 fixed to the lower back rim 20 to extend upwardly and rearwardly therefrom.

In use the helmet is held on the head of a wearer cyclist by a chin strap 22 fixed to the sides of helmet 12 intermediate said front and back rims. Wind pressure against the face shield 14 and front of the helmet tends to force the helmet and head of the wearer cyclist back and downwardly in counterclockwise movement. Wind pressure against the inverted upwardly and backwardly extending visor tends to push the head of the wearer down and forwardly in clockwise movement. The two movements counteract each other, dependent upon speed of cycle and tilt of head, to releave neck muscles of all front and rear stresses.

As speeds are increased, wind pressure is increased on the front of the helmet which is met by tilting the head and helmet forwardly thereby increasing wind pressures thereon the inverted visor and lessening it on the back of helmet. Tilting and head and helmet up reverses the wind pressures. The amounts of tilt in each case is determined by the motorcyclist for minimum neck muscle stress for the motorcycle speed by the counter-acting front and back wind pressures aerodynamically stabilizing the helmet.

What is claimed is:

1. On a motorcycle helmet having front and back lower rims, a front downwardly depending face shield and a chin strap, an inverted visor fixed to said lower back rim and extending upwardly and outwardly around the rear of said helmet for inducing counteracting wind pressures to the wind pressures due to forward motion of of a motorcycle and helmet wearer proportional to the amount of forward and backward tilt of wearer's head and helmet according to increase and decrease, respectively, of motorcycle speeds.

2. The method of aerodynamically stabilizing a motorcycle helmet to varying speeds of said motorcycle by helmet wearer, comprising the steps of:

(a) fixing an inverted visor to a lower back rim of said helmet to extend upwardly and rearwardly around the lower back thereof; and (b) tilting said helmet wearer's head and helmet forwardly proportional to an increase in speed of said motorcycle and backwardly similarly for speed decreases until neck muscles of said helmet wearer's head are maximally relaxed by the counteraction of front and rear wind pressures.

* * * * *